US012061009B2

(12) United States Patent
Mcrae

(10) Patent No.: US 12,061,009 B2
(45) Date of Patent: Aug. 13, 2024

(54) MAGNETIC VENT COVER

(71) Applicant: IMPACT MACHINE DESIGN INC., Toronto (CA)

(72) Inventor: Vincent Philip Mcrae, Barrie (CA)

(73) Assignee: IMPACT MACHINE DESIGN INC., Toronto (CA)

( * ) Notice: Subject to any disclaimer, the term of this patent is extended or adjusted under 35 U.S.C. 154(b) by 200 days.

(21) Appl. No.: 17/494,157

(22) Filed: Oct. 5, 2021

(65) Prior Publication Data

US 2023/0105921 A1 Apr. 6, 2023

(51) Int. Cl.
*F24F 13/08* (2006.01)
*F24F 13/14* (2006.01)

(52) U.S. Cl.
CPC ..... *F24F 13/082* (2013.01); *F24F 13/1426* (2013.01); *F24F 2013/148* (2013.01)

(58) Field of Classification Search
CPC ..... F24F 13/082; F24F 13/1426; F24F 2013/146; F24F 2013/148
USPC ..... 454/336
See application file for complete search history.

(56) References Cited

U.S. PATENT DOCUMENTS 8,419,515 B1 * 4/2013 Dillon ..... F24F 13/084 454/284

FOREIGN PATENT DOCUMENTS

CA 3037517 A1 * 9/2020

* cited by examiner

*Primary Examiner* — Allen R. B. Schult
(74) *Attorney, Agent, or Firm* — Thompson Hine LLP

(57) ABSTRACT

A vent cover for an air duct having (a) a top surface with an aperture, (b) an actuating member extending through the aperture and operably connected to a magnet selectively engageable with the air duct, and (c) a bias means for urging the magnet towards the air duct, the actuating member movable between a securing position and a releasing position, wherein in the securing position the bias means urges the magnet towards the air duct, and in the releasing position the actuating member moves the magnet away from the air duct to allow the vent cover to be removed from the air duct.

9 Claims, 5 Drawing Sheets

MAGNETIC VENT COVER

FIELD OF THE INVENTION

The present invention relates generally to the field of heating, ventilation and air-conditioning (HVAC) systems that utilize air vents, also referred to as registers, for the transfer of air from ducts into living and work areas within homes or buildings. Such systems also utilize air vents, typically known as cold air returns, to convey air from the living and work areas to other parts of the system, or even to the exterior. More specifically, the present invention is a magnetic cover for such vents that can be easily installed or removed.

BACKGROUND OF THE INVENTION

Air forced through HVAC systems is generally output through ducts to one or more vents, also referred to as registers, which are located in predetermined positions in the living or working spaces of a building. Depending on the construction of the building and design factors, these vents may be located on the building's floors, walls, or ceilings, or in some combination of these locations. Typically, duct work for HVAC systems comprises sheet metal that terminates at or near the back side of an interior surface, such as wallboard, panelling, flooring, or other commonly used interior building surface material.

The common air vent or register cover, covers the hole in the floor, wall or ceiling where the HVAC or other ventilation duct enters a room. The air vent cover is either set in place on the floor or is mounted on a wall or ceiling. Most commonly, traditional vent covers are screwed into place in order to hold the vent cover within the vent. As such, traditional vent covers are not easily removed for cleaning, maintenance, and so forth. Further, As these screws are typically placed into the surface material without any plug or similar device, removal for cleaning or maintenance or other reasons typically weakens the interior surface material at the screw location, making it more difficult to achieve a tight fit of the vent cover to the vent.

SUMMARY OF THE INVENTION

The present invention provides an air flow vent cover of a heating, ventilation and air conditioning unit (HVAC) system that utilizes magnets to attach to duct work. The magnets are positioned on opposite sides of the vent cover to securely hold the vent cover in place. Each of the magnets is connected to a tab via a spring, wherein the tab can be manipulated in order to position the corresponding magnet away from the wall of the vent, thus overcoming the magnetic force and allowing the present invention to be easily removed.

In one embodiment, the present invention provides for a vent cover for covering a terminal end of air duct work, the vent cover comprising: (a) a top surface comprising at least one aperture therethrough; (b) at least one actuating member disposed within the at least one aperture and operably connected to a magnet, the magnet selectively positionable against the air duct work; and (c) a bias means for biasing the at least one actuating member into a securing position wherein the magnet is adjacent the air duct work to secure the top surface against the terminal end of the air duct work; the at least one actuating member movable between the securing position and a releasing position, wherein in the releasing position the at least one actuating member opposes the bias means to space the magnet from the air duct work to allow the top surface to be moved away from the air duct work.

In some exemplary embodiments of the present invention, the top surface comprises opposed lateral edges and opposed side edges extending between the opposed lateral edges. The at least one aperture may comprise a plurality of vanes, adjacent vanes separated by a space.

Some exemplary embodiments further comprise opposed lateral walls extending outwardly from the top surface to define an interior cavity adjacent the top surface. Movable opposed end walls may extend between the opposed lateral walls, the opposed end walls slidably engaged with the opposed lateral walls for lateral movement therealong, the opposed lateral walls and the opposed end walls sized to fit within the terminal end of the air duct work. The magnet can then mounted on the opposed end wall with the opposed end walls selectively movable by the at least one actuating member. The bias means may be positioned in the interior cavity, and the bias means may be at least one spring positioned within the interior cavity.

In some embodiments the at least one actuating member is at least one tab, and the bias means may comprise a spring-loaded element.

In some exemplary embodiments wherein the air duct work is non-metallic, a metallic housing is mountable in the terminal end of the air duct work and for receipt of the top surface thereon, wherein in the securing position the magnet is adjacent the metallic housing to secure the top surface against the terminal end of the air duct work through the metallic housing.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

The construction of the invention will be described in reference to the accompanying drawings in which.

DETAILED DESCRIPTION OF THE INVENTION

Figure 1:
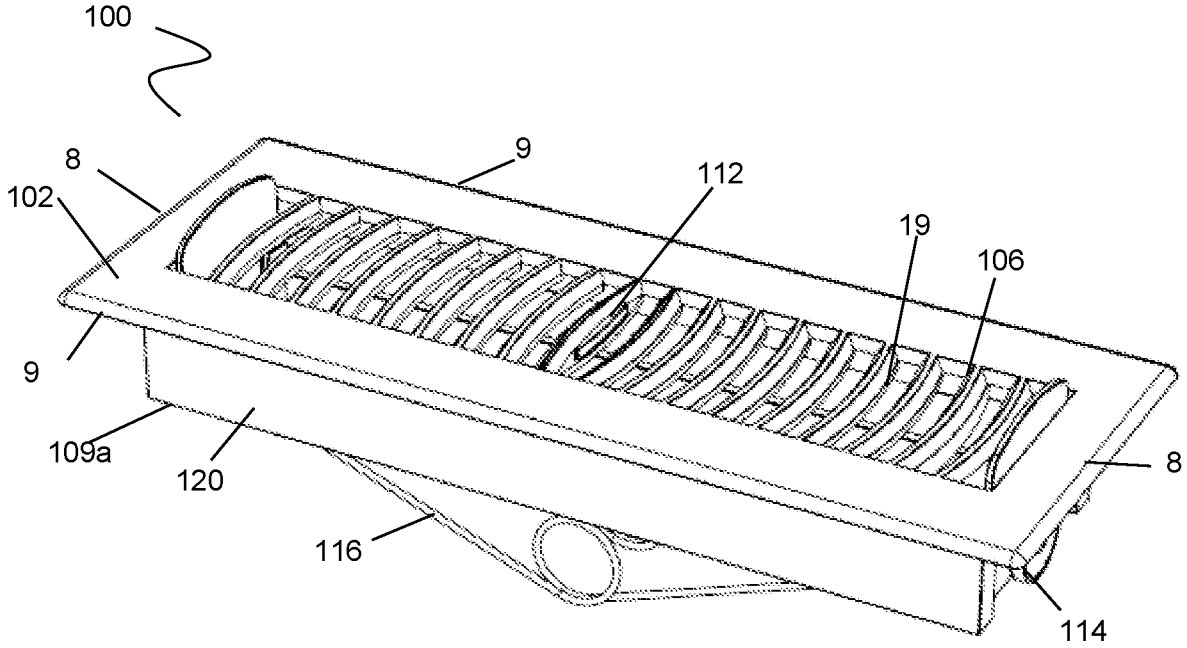
FIG. 1 is a top perspective view of a magnetic vent cover in accordance to one embodiment of the present invention.
Figure 2:
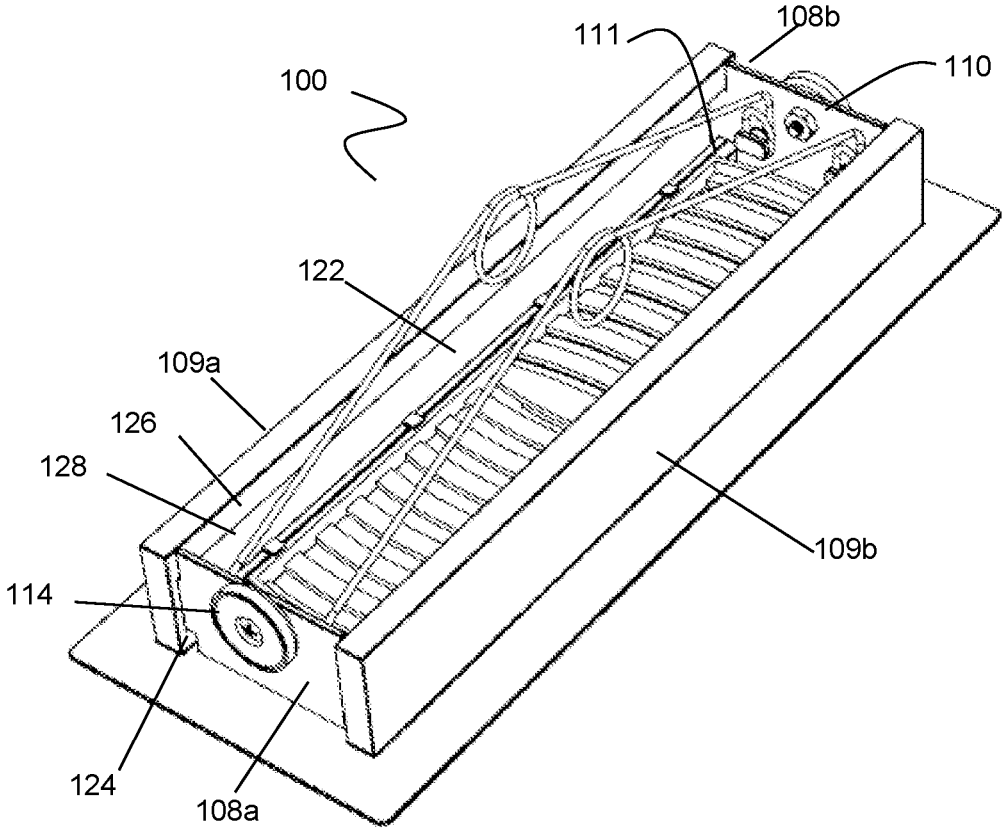
FIG. 2 is a bottom perspective view of a magnetic vent cover in accordance to one embodiment of the present invention.

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense.

Unless defined otherwise, all technical and scientific terms used herein have the same meaning as commonly understood by one of ordinary skill in the art to which this invention belongs. Also, unless indicated otherwise, except within the claims, the use of "or" includes "and" and vice versa. Non-limiting terms are not to be construed as limiting unless expressly stated or the context clearly indicates otherwise (for example "including", "having" and "comprising" typically indicate "including without limitation"). Singular forms including in the claims such as "a", "an" and "the" include the plural reference unless expressly stated otherwise.

The present invention is a vent cover, or register cover, for use in homes and buildings where there are central air ducts. The present invention is all one piece and installs quickly and easily, replacing an existing vent cover without any modification to the vent opening. The present invention uses a magnets located on at least two portions of the vent cover, which magnetically bond to the inner walls of the vent duct of the HVAC system. The use of magnets saves time and eliminates the risk of losing important screws and the need for a screwdriver. Further, the present invention avoids screw holes in the building interior surface material, which are unsightly and may be prone to structural failure if the cover is repeatedly removed for cleaning, maintenance, or similar purposes.

FIGS. 1 to 7 illustrates a vent cover 100 according to one embodiment of the present invention. The vent cover 100 includes a top surface 102 having opposite lateral edges 9, opposite side edges 8 extending between the opposite lateral edges 9, and a plurality of vanes or louvers 106 running between opposite side edges 8. Adjacent vanes 106 are separated by space 19. The vent cover 100 also includes opposite lateral walls 109*a,b* (also referred to as side walls) extending from the top surface 102. The lateral walls 109*a,b* define an opening 110 opposite to the top 102 and an interior cavity 111.

The vent cover 100 also includes movable or slidable opposite end walls 108*a,b* perpendicular to the lateral walls 109*a,b*.

The vent cover of the present invention may be provided with an air flow adjustment plate or sliding vent 104, as is common in the art. The sliding vent 104 may be placed under the top surface 102 which also includes a plurality of vanes 107. A vane actuator 112 of the air flow adjustment plate may also be included to alter the angle and/or amount at which the air exits the vent cover 100.

The vent cover 100 is configured for insertion into a terminal end of a HVAC duct such that air from the HVAC passes through the housing 100. In particular, the lateral walls 109*a,b* and the end walls 108*a,b* are sized and dimensioned to fit within the opening of the duct work on the interior building surface, such that the vent cover may be easily placed within the duct work opening and also to allow for the vent cover to magnetically attach to the duct work.

The lateral walls 109*a,b* include an exterior surface 120 and an interior surface 122 that faces the interior cavity 111. The interior surface 122 includes an upper shoulder 124, a lower shoulder 126, and an interior surface 128 extending between the upper and lower shoulders 124, 126 which serve as slide guide units for the opposite end walls 108*a,b*. As shown in the figures, shoulders 124, 126 can be "L" or inverted "L" shaped. However, they could take any other suitable shape, such as a "V" or inverted "V" shape.

At least one of the movable opposite end walls 108*a,b* include one or more magnets 114 that are configured to interact with the end walls of a vent duct to hold the vent cover 100 in place.

Figure 3:
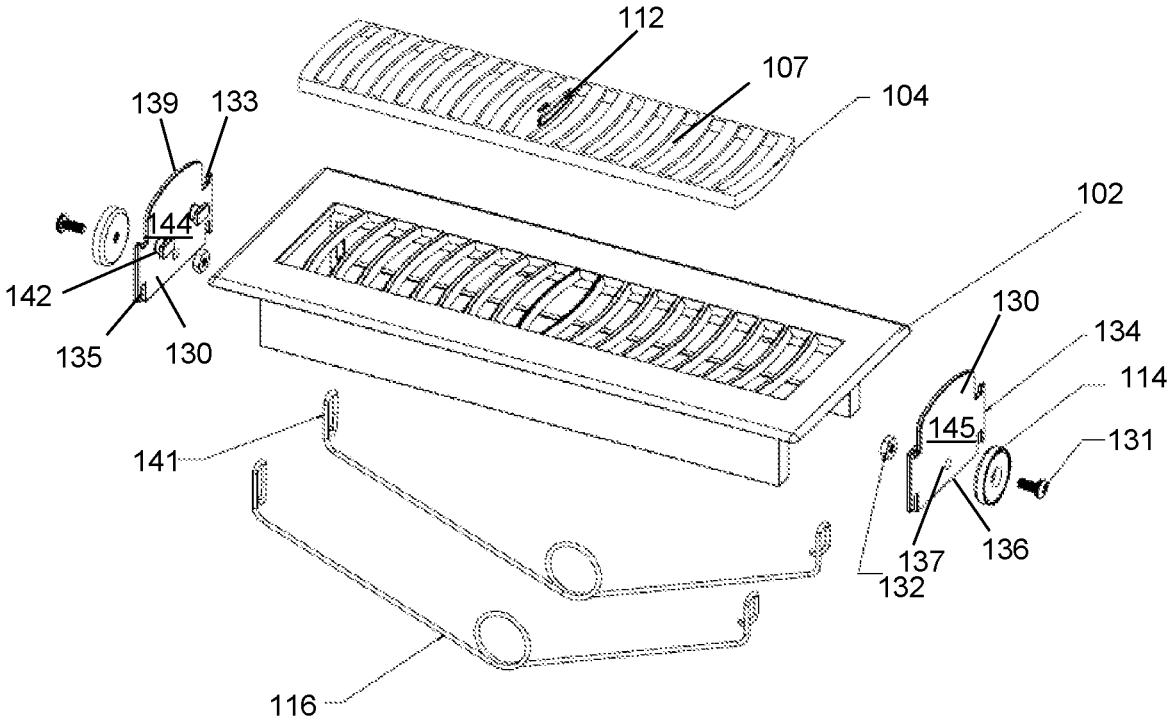
FIG. 3 is an exploded view of a magnetic vent cover in accordance to one embodiment of the present invention.
Figure 4:
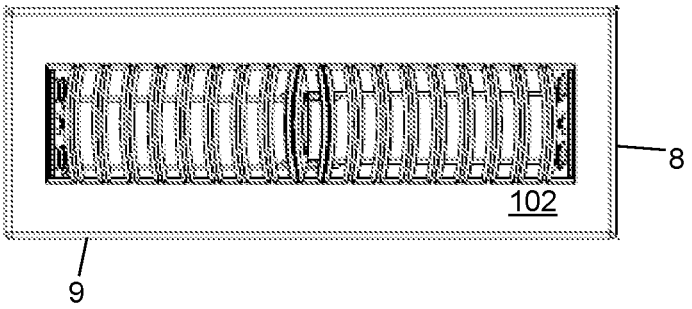
FIG. 4 is a plan top view of a magnetic vent cover in accordance to one embodiment of the present invention.
Figure 5A:
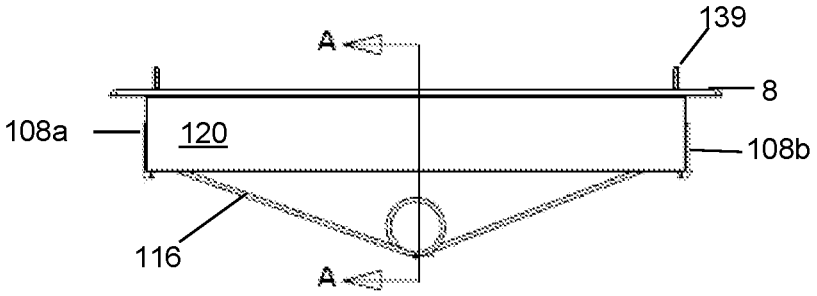
FIG. 5A is a plan lateral or front view of a magnetic vent cover in accordance to one embodiment of the present invention.
Figure 5B:
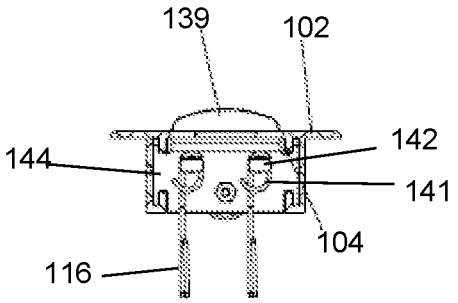
FIG. 5B is a cross sectional view through A-A of the magnetic vent cover of FIG. 5A.
Figure 6:
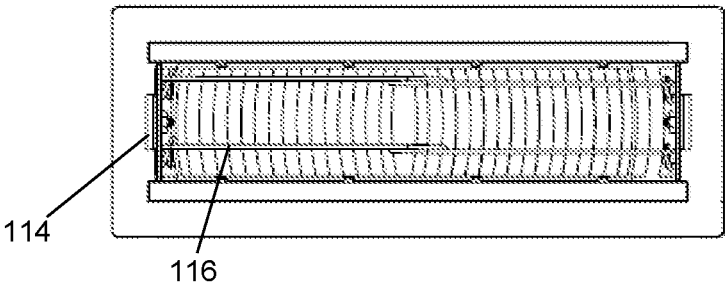
FIG. 6 is a plan bottom view of a magnetic vent cover in accordance to one embodiment of the present invention.
Figure 7:
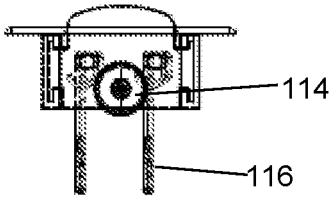
FIG. 7 is a plan side view of a magnetic vent cover in accordance to one embodiment of the present invention.

With reference to FIG. 3 each opposite movable end wall 108 includes a plate 130 having an interior face 144, an exterior face 145, lateral sides 134, a bottom side 136, and a top side 138. The top side includes a tab 139. The lateral sides 134 include an upper groove 133 and a lower groove 135. The upper 133 and lower 135 grooves are configured to receive, respectively, the upper 124 and lower 126 shoulders of the lateral walls 109*a,b*, such that the plate 130 can slide along the shoulders 124, 126. That is, the dimensions of the upper and lower grooves 133, 135 are commensurate with the dimensions of the interior shoulders 124, 126. The plate 130 also includes means 137 for receiving the one or more magnets 114. The means for receiving the one or more magnets 114 may include a hole 137 that serves to secure the magnet 114 with connecting devices such as a screw 131 and nut 132.

When the plate 130 is coupled to the lateral walls 109*a,b*, the tab 139 extends through a space 19 between two neighbouring vanes 106, and through space 107. As such, the plate 130 can slide on the shoulders 124, 126 only in the space 109 between two consecutive vanes 106.

In one embodiment, each of the end walls 108*a,b* of the vent cover 100 are urged towards the side edges 9 of the top surface 102 by a bias means for bringing the one or more magnets 114 in magnetic proximity to the end walls of a ventilation duct. That is, the bias means urges the magnets closer to the ends of the air duct thereby bonding or securing the vent cover 100 to the duct work of the HVAC system. The bias means includes a spring-loaded element 116, which could be a spring made of steel or any other suitable material, a spring connection tab 139. The spring 116 may include loops 141 at its opposite ends. The spring 116 urges the plates 130 to move the one or more magnets 114 towards the side edge 9. The spring 116 is coupled to the plate 130 through knobs 142 located on the interior face 144 of the plate 130 designed to receive or accept loops 141. The tabs 139 are accessible from the front top surface 102 of the vent 100 and allow a user to break the magnetic bond with the vent and thus allow for easy removal of the vent covers. That is, a user may press the tab 139 away from the side edge 9 thereby breaking the magnetic bond to the air duct. This allows for quick and easy access to vents, and the wall area covered by the vent cover for maintenance, cleaning, painting, etc.

Figure 8A:
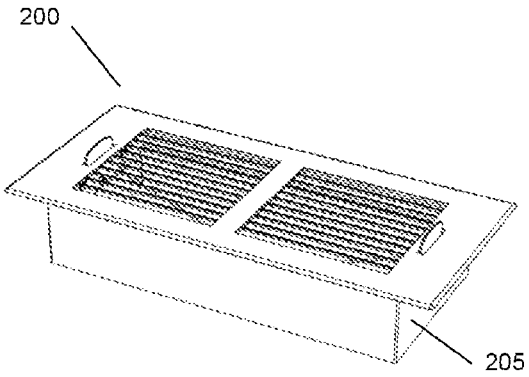
FIG. 8A is a top perspective view of a magnetic vent cover in accordance to another embodiment of the present invention.
Figure 8B:
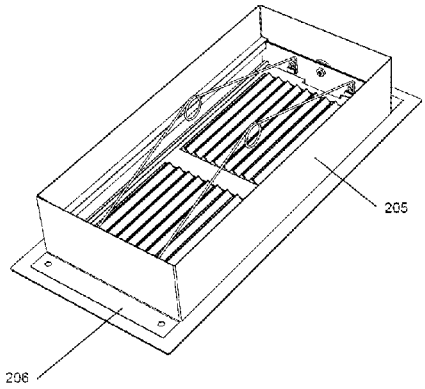
FIG. 8B is a bottom perspective view of the magnetic vent cover of FIG. 8A.

FIGS. 8A and 8B show a further embodiment of the magnetic vent cover of the present invention. The magnetic vent cover 200 generally corresponds to the vent cover 100 described above and includes a metallic housing 205, with end flanges 206. The housing 205 is dimensioned to fit within the duct work opening in the interior building surface.

This embodiment can be used when the duct work is non-metallic, preventing magnetic attachment of the vent cover described above. The housing 205 is placed within the duct work opening and the flanges 206 are attached to the interior surface the building material by a suitable means, such as screws, nails or adhesive. Once the housing is in place, the body of the vent cover 200 is placed within the housing 200 and operated as described above, to allow for magnetic attachment of the body of the vent cover to the housing 205.

The perimeter of the lateral walls and the end walls can be made in a variety of dimensions and finishes to accommodate various size vents and ornamental preferences. In some embodiments, the vent cover is manufactured from light weight plastic that can be made with faux finishes to match various interiors. In some embodiments, the vent cover may be 3D printed of a suitable material.

The above disclosure generally describes the present invention. However, this description should not be construed as limiting the scope of the invention but as merely providing illustrations of some of the embodiments of this invention. Thus the scope of the invention should be determined by the appended claims and their legal equivalents, rather than by the examples given.

I claim:

1. A vent cover for covering a terminal end of air duct work, the vent cover comprising:

(a) a top surface comprising at least one aperture therethrough, opposed lateral walls extending outwardly from the top surface to define an interior cavity adjacent the top surface, and movable opposed end walls extending between the opposed lateral walls, wherein the opposed end walls are slidably engaged with the opposed lateral walls for lateral movement therealong, and the opposed lateral walls and the opposed end walls are capable of being sized to fit within the terminal end of the air duct work;

(b) at least one actuating member disposed within the at least one aperture and operably connected to a magnet, the magnet selectively positionable against the air duct work; and (c) a bias means for biasing the at least one actuating member into a securing position wherein the magnet is adjacent the air duct work to secure the top surface against the terminal end of the air duct work;

the at least one actuating member movable between the securing position and a releasing position, wherein in the releasing position the at least one actuating member opposes the bias means to space the magnet from the air duct work to allow the top surface to be moved away from the air duct work.

2. The vent cover of claim 1 wherein the top surface comprises opposed lateral edges and opposed side edges extending between the opposed lateral edges.

3. The vent cover of claim 1 wherein the at least one aperture comprises a plurality of vanes, adjacent vanes separated by a space.

4. The vent cover of claim 1 wherein the magnet is mounted on at least one of the opposed end walls and the opposed end walls are selectively movable by the at least one actuating member.

5. The vent cover of claim 1 wherein the at least one actuating member is at least one tab.

6. The vent cover of claim 1 wherein the bias means comprises a spring-loaded element.

7. The vent cover of claim 1 wherein the bias means is positioned within the interior cavity.

8. The vent cover of claim 7 wherein the bias means is at least one spring positioned within the interior cavity.

9. The vent cover of claim 1 wherein the air duct work is non-metallic, further comprising a metallic housing mountable in the terminal end of the air duct work and for receipt of the top surface thereon, wherein in the securing position the magnet is adjacent the metallic housing to secure the top surface against the terminal end of the air duct work through the metallic housing.

* * * * *